US008864296B2

(12) United States Patent
Yildirim et al.

(10) Patent No.: US 8,864,296 B2
(45) Date of Patent: Oct. 21, 2014

(54) SYSTEM FOR PRIMING A FLUID DISPENSER BY EXPANDING GAS BUBBLES

(75) Inventors: Ozgur Yildirim, Albany, OR (US); Ralph Stathem, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1223 days.

(21) Appl. No.: 12/238,752

(22) Filed: Sep. 26, 2008

(65) Prior Publication Data

US 2009/0189941 A1 Jul. 30, 2009

Related U.S. Application Data

(60) Provisional application No. 61/024,817, filed on Jan. 30, 2008.

(51) Int. Cl.

| | |
|---|---|
| ***B41J 2/19*** | (2006.01) |
| ***B41J 29/38*** | (2006.01) |
| ***B41J 2/17*** | (2006.01) |
| ***B41J 2/175*** | (2006.01) |

(52) U.S. Cl.

CPC *B41J 2/19* (2013.01); *B41J 2/1707* (2013.01); *B41J 2/1753* (2013.01)

USPC ..... 347/92; 347/17

(58) Field of Classification Search

USPC ..... 347/92

See application file for complete search history.

(56) References Cited

U.S. PATENT DOCUMENTS

| | | | | |
|---|---|---|---|---|
| 5,039,999 | A * | 8/1991 | Winslow et al. | 347/87 |
| 5,781,204 | A | 7/1998 | Kanematsu et al. | |
| 6,130,693 | A | 10/2000 | Ims et al. | |
| 6,299,673 | B1 * | 10/2001 | Field et al. | 347/92 |
| 6,336,700 | B1 * | 1/2002 | Hays et al. | 347/92 |
| 2002/0036672 | A1 | 3/2002 | Courtney et al. | |
| 2003/0063148 | A1 * | 4/2003 | Tanaka | 347/5 |
| 2005/0062816 | A1 * | 3/2005 | Yildirim et al. | 347/92 |

FOREIGN PATENT DOCUMENTS

| | | | | |
|---|---|---|---|---|
| EP | 564069 | A2 * | 10/1993 | B41J 2/16 |
| JP | 57-087964 | | 6/1982 | |
| JP | 58-101066 | | 6/1983 | |
| JP | 59-225959 | | 12/1984 | |
| JP | 61-233549 | | 10/1986 | |
| JP | 03-182361 | | 8/1991 | |
| JP | 06-320760 | | 11/1994 | |
| WO | 95/12109 | A1 | 5/1995 | |

* cited by examiner

*Primary Examiner* — Shelby Fidler

(57) ABSTRACT

A fluid-dispensing head includes a plenum configured to house fluid; at least one dispensing head orifice in fluid communication with the ink plenum; and at least one heating element configured to heat fluid in the head such that gas bubbles disposed within the fluid increase in surface area.

9 Claims, 7 Drawing Sheets

SYSTEM FOR PRIMING A FLUID DISPENSER BY EXPANDING GAS BUBBLES

CROSS-REFERENCE TO RELATED APPLICATIONS

This application claims the benefit of U.S. Provisional patent application Ser. No. 61/024817, filed on 30 Jan. 2008, which is hereby incorporated by reference in its entirety.

BACKGROUND

Inkjet printing technology is used to print documents in many homes and businesses. Inkjet printers typically operate by selectively dispensing tiny droplets of liquid ink onto a print medium in a pattern corresponding to the desired text and/or images.

Many inkjet printers have a printing cartridge with an incorporated printhead having orifices through which liquid ink is expelled onto the print medium. Various print cartridge configurations exist. One configuration is that of a disposable print cartridge, typically including a self-contained ink or fluid reservoir and a printhead. Once the fluid reservoir is depleted, the print cartridge is replaced with a fresh cartridge. In other configurations, permanent or semi-permanent cartridges may receive liquid ink from a replaceable supply.

In inkjet printing, it is often important to maintain a sufficiently primed supply of ink to the printhead. However, when a print cartridge is first installed, or after long periods of disuse, one or more pockets of air may be present within the ink channels of the printhead. Under such circumstances, it may be desirable to prime the printhead by establishing a flow through the ink channels and out the nozzles such that any air bubbles are flushed out of the printhead.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

As mentioned above, it may be desirable to prime an inkjet printhead or other fluid dispenser by removing gaseous bubbles disposed within liquid ink channels to and in the printhead. In some cases, it may be easier to move and push larger bubbles out of the dispensing head than smaller bubbles. Thus, it may be desirable to facilitate the enlargement or aggregation of gaseous bubbles within the liquid ink channels of fluid-dispensing heads. Moreover, it may also be desirable to reduce the surface tension in gaseous bubbles within the liquid ink channels of a fluid-dispensing head to facilitate the removal of the gaseous bubbles from the orifices within the dispensing head.

To better accomplish these goals, the present specification discloses illustrative systems and methods for priming a fluid-dispensing head, such as an inkjet printhead. The systems and methods may involve heating liquid ink within the dispensing head such that gaseous bubbles present in the liquid ink increase in size and reduce in surface tension.

As used in the present specification and in the appended claims, the term "fluid-dispensing head" or "dispensing head" refers to a device within a fluid dispenser, such as an inkjet printer, having at least one orifice through which fluid or liquid, such as ink, may be selectively deposited, for example, onto a print medium, such as a sheet of paper or other print media. In some fluid dispensers, a dispensing head or printhead may be a component in a replaceable and disposable cartridge.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The principles disclosed herein will now be discussed with respect to illustrative systems and methods.

Illustrative Systems

Figure 1:
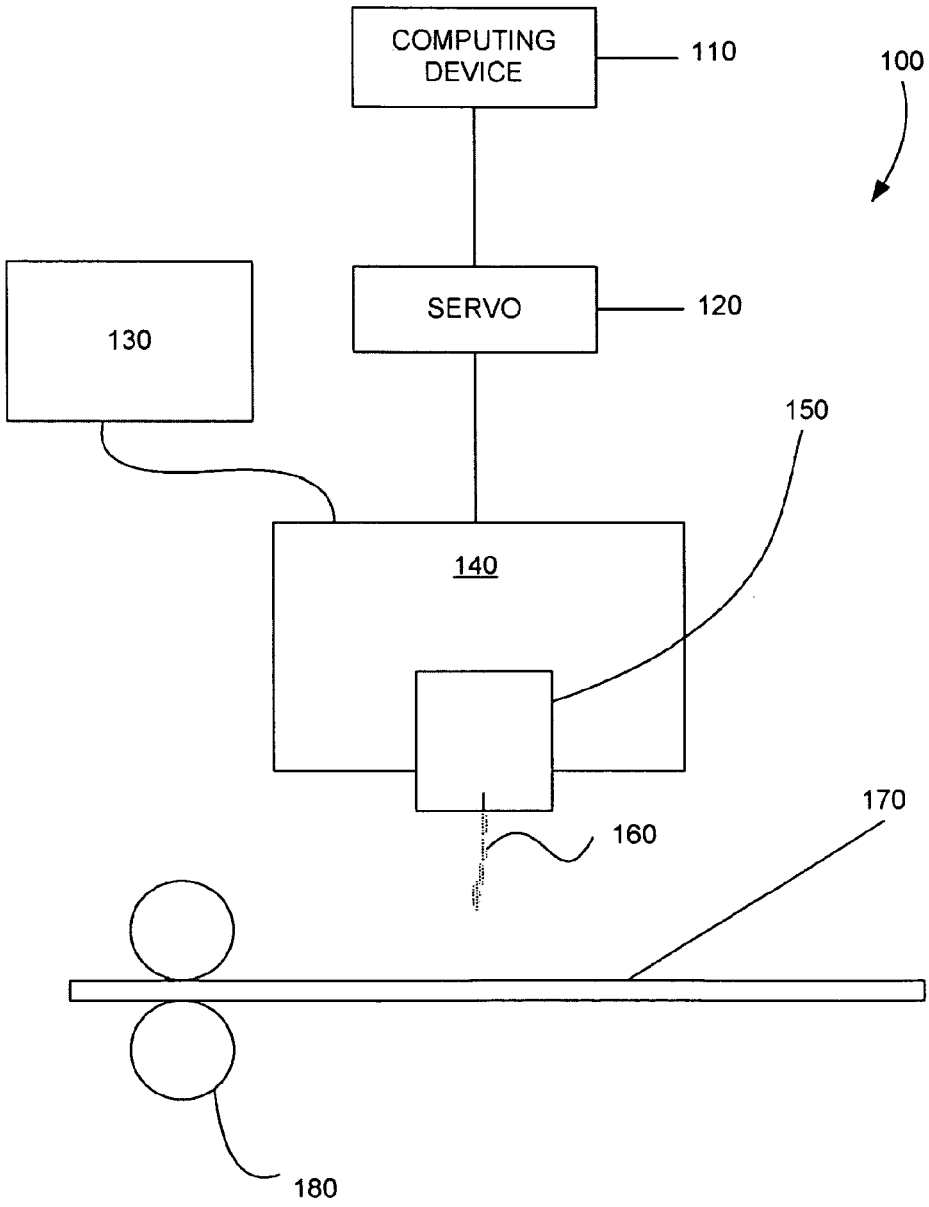
FIG. 1 is a block diagram of an embodiment of an illustrative fluid-dispensing system, according to principles described herein.

Referring now to FIG. 1, an illustrative fluid-dispensing system (100) is shown. The illustrative system (100) may be used as a printing system configured to form a desired image on a print medium (170), for example, a sheet of paper other print medium. The present exemplary system (100) may include a computing device (110) controllably coupled through a servo mechanism (120) to a moveable carriage (140) having a fluid dispenser (150) disposed thereon. The computing device (110) may control both the servo mechanism (120) and the fluid dispenser (150), for example, to form a desired image on the print medium (170). A liquid material reservoir (130) may be coupled to the moveable carriage (140), and consequently, to the fluid dispenser (150) so as to provide fluid as needed to the dispenser (150). One or more rollers (180) or other media transport devices may be located adjacent to the dispenser (150) and configured to selectively position the fluid-receiving medium (170) relative to the dispenser (150). The above-mentioned components of the present illustrative system (100) will now be described in further detail below.

The computing device (110) that is controllably coupled to the servo mechanism (120) and the fluid dispenser (150), as shown in FIG. 1, may control the selective deposition of fluid (160) from the dispenser (150) to the fluid-receiving medium (170). In the example of an inkjet printing system, a representation of a desired image or text may be formed using a program hosted by the computing device (110), such as a printer driver. That representation may then be converted into servo instructions. In other fluid-dispensing applications, similar servo instructions may be generated for positioning the dispensing head (150) relative to a fluid-receiving medium (170), such as a carrier for a liquid medicament.

When accessed by the computing device (110), these instructions are used to control the servo mechanism (120) to selectively position the movable carriage (140) and fluid dispenser (150). The computing device (110) may be, but is in no way limited to, a workstation, a personal computer, a laptop, a digital camera, a personal digital assistant (PDA), or any other processor-containing device.

The moveable carriage (140) of the present illustrative system (100) may support and position any number of fluid dispensers (150) configured to selectively dispense the fluid (160) used by the system, for example, ink. The moveable carriage (140) may be controlled by a computing device (110) and may be controllably moved by, for example, a shaft system, a belt system, a chain system, etc. making up the servo mechanism (120). As the moveable carriage (140) operates, the computing device (110) may inform a user of operating conditions as well as provide the user with a user interface.

In a printing application, as a desired image or text is printed on the fluid-receiving medium (170), the computing device (110) may controllably position the moveable carriage (140) and direct one or more of the fluid dispensers (150) to selectively dispense an inkjet ink at predetermined locations on the medium (170) as digitally addressed drops, thereby forming the desired image or text. The fluid dispensers (150) used by the present exemplary system (100) may be any type of fluid dispenser configured to perform the present method including, but in no way limited to, thermally actuated fluid dispensers, mechanically actuated fluid dispensers, electrostatically actuated fluid dispensers, magnetically actuated fluid dispensers, piezoelectrically actuated dispensers, continuous fluid dispensers, etc. Additionally, the present fluid-receiving medium (170) may receive fluids from other sources such as, but in no way limited to, screen printing, stamping, pressing, gravure printing, and the like.

The fluid reservoir (130) that is fluidly coupled to the fluid dispenser (150) may house and supply a fluid (160), such as an inkjet ink to the fluid dispenser. The fluid reservoir (130) may be any container configured to hermetically seal the fluid (160) prior to dispensing.

According to the present exemplary embodiment, the fluid (160) contained by the reservoir (130) may include, but is in no way limited to, pigment-based and dye-based inkjet inks. Appropriate dye-based inks include, but are in no way limited to anionic dye-based inks having water-soluble acid and direct dyes. Similarly, appropriate pigment-based inks include both black and colored pigments. Moreover, the inkjet ink compositions of the present exemplary systems and methods are typically prepared in an aqueous formulation or liquid vehicle that can include, but is in no way limited to, water, cosolvents, surfactants, buffering agents, biocides, sequestering agents, viscosity modifiers, humectants, binders, and/or other known additives.

FIG. 1 also illustrates the components of the fluid-dispensing system that may facilitate reception of the fluid (160) onto the fluid-receiving medium (170). As shown in FIG. 1, a number of positioning rollers (180) may transport and/or positionally secure the medium (170) during a fluid-dispensing operation. Alternatively, any number of belts, rollers, substrates, or other transport devices may be used to transport and/or positionally secure the ink receiving substrate (170) during a printing operation, as is well known in the art.

Figure 2:
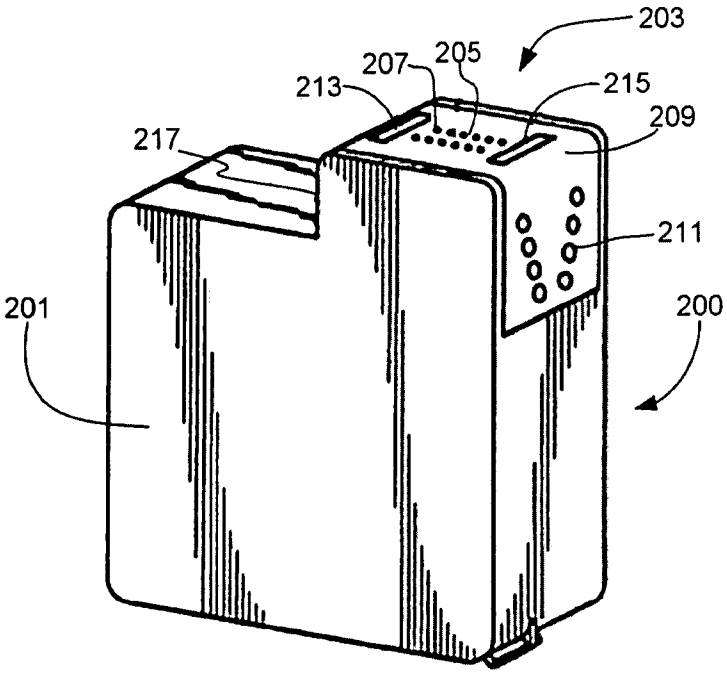
FIG. 2 is a diagram of an embodiment of an illustrative fluid-dispensing cartridge, such as an inkjet printing cartridge, according to principles described herein.

Referring now to FIG. 2, an illustrative inkjet print cartridge (200) according to principles described herein is shown. It will be appreciated, however, that the principles described herein for priming a fluid-dispensing system may be applied to any drop-on-demand or other controlled fluid-dispensing system, not just to an inkjet print cartridge. Such fluid-dispensing systems are used in such diverse applications as fuel injection and dispensing therapeutic amounts of a medicament.

The inkjet print cartridge (200) may include an ink reservoir (201) and a dispensing head (203) which may perform at least some of the functions of the fluid material reservoir (130, FIG. 1) and the dispenser (150, FIG. 1) described previously. In some embodiments, the dispensing head (203) may be formed using Tape Automated Bonding (TAB), a well-known technique in the art. The dispensing head (203) may also include a nozzle member (205) having parallel columns of offset holes or orifices (207) formed in a flexible polymer tape (209) by, for example, laser ablation. The tape (209) may be purchased commercially as Kapton™ tape, available from 3M™ Corporation. Other suitable tape may be formed of Upilex™ or any other tape, as may suit a particular application.

A back surface of the tape (209) may include conductive traces (shown in FIG. 4) formed thereon using a conventional photolithographic etching and/or plating process. These conductive traces may be terminated by large contact pads (211) designed to interconnect with a printer. The print cartridge (200) may be designed to be installed in a printer such that the contact pads (211), on the front surface of the tape (209), contact printer electrodes providing externally generated energization signals to the dispensing head (203).

The aforementioned traces may be formed on the back surface of the tape (209) (opposite the surface which faces the fluid-receiving medium). To access these traces from the front surface of the tape (209), holes (vias) may be formed through the front surface of the tape (209) to expose the ends of the traces. The exposed ends of the traces may then be plated with, for example, gold to form the contact pads (211) shown on the front surface of the tape (209).

Windows (213, 215) extend through the tape (209) and are used to facilitate bonding of the other ends of the conductive traces to electrodes on a silicon substrate containing heater resistors. The windows (213, 215) are filled with an encapsulant to protect any underlying portion of the traces and substrate.

In the print cartridge (200) of the present example, the tape (209) is bent over the back edge of the print cartridge "snout" and extends approximately one half the length of a back wall (217) of the snout. This flap portion of the tape (209) may be useful for the routing of conductive traces which may be connected to the substrate electrodes through the far end window (213).

Figure 3:
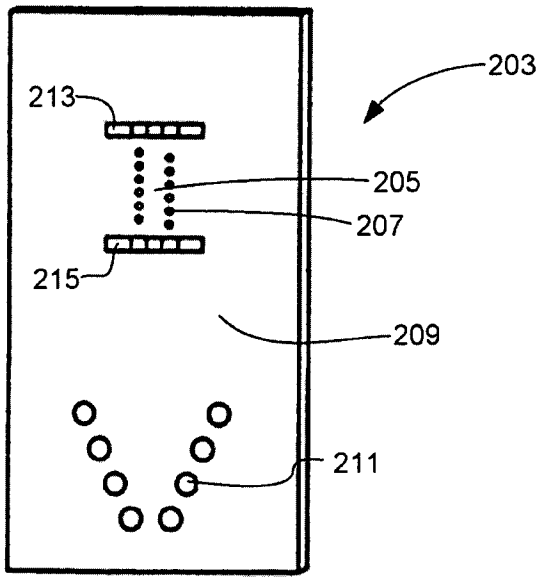
FIG. 3 is a diagram of an embodiment of an illustrative dispensing head, according to principles described herein.

FIG. 3 shows a front view of an illustrative dispensing head (203), removed from the print cartridge (200) and prior to windows (213, 215) in the dispensing head (203) being filled with an encapsulant.

A semiconductor die (shown in FIG. 4) may be affixed to the back of the dispensing head (203). The die may include a plurality of individually energizable thin film resistors. Each resistor may be located generally behind a single orifice (207) and act as an ohmic heater when selectively energized by one or more pulses applied sequentially or simultaneously to one or more of the contact pads (211).

The orifices (207) and conductive traces may be of any size, number, and pattern, as suits a particular application. The orifice pattern on the tape (209) shown in FIG. 3 may be formed by a masking process in combination with a laser or other etching means according to principles understood by those familiar with the art.

Figure 4:
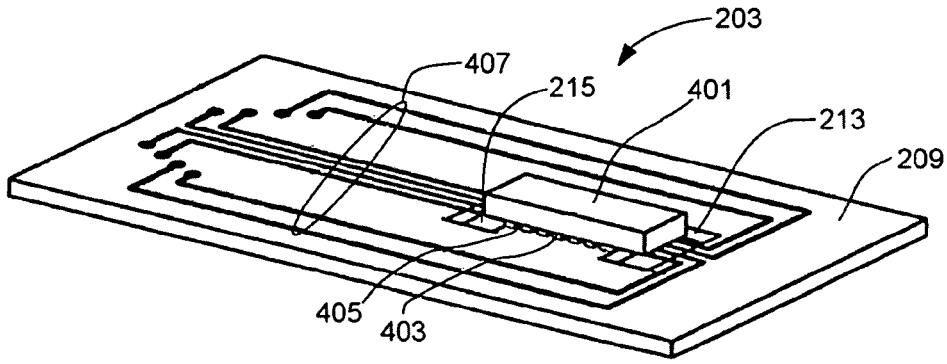
FIG. 4 is a diagram of a perspective view of an embodiment of an illustrative dispensing head, according to principles described herein.

Referring now to FIG. 4 a back surface of the illustrative dispensing head is shown. The semiconductor die (401) mentioned above may be mounted to the back of the tape (209). One edge of a barrier layer (403) formed on the semiconductor die (401) may contain ink channels and vaporization chambers. Shown along the edge of the barrier layer (403) are the entrances of ink channels (405) which may receive fluid from the reservoir (201, FIG. 2).

Portions of conductive traces (407) formed on the back of the tape (209) are also shown in FIG. 3. The traces (407) terminate in contact pads (211, FIG. 2) on the opposite side of the tape (209). The windows (213, 215) may allow access to the ends of the traces (407) and the substrate electrodes from the other side of the tape (209) to facilitate bonding.

Figure 5:
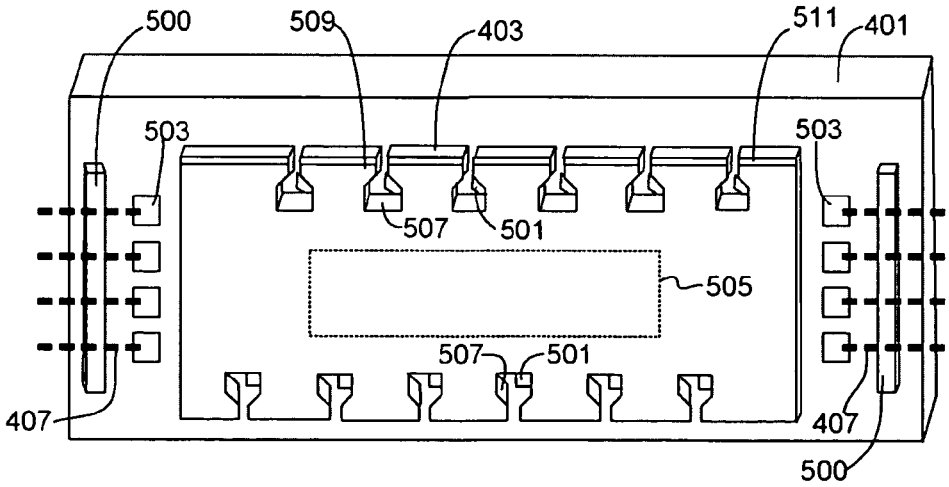
FIG. 5 is a diagram of an embodiment of an illustrative die in a dispensing head, according to principles described herein.

Referring now to FIG. 5, a front perspective view of an illustrative semiconductor die (401, FIG. 4) is shown. The semiconductor die (401, FIG. 4) may have formed thereon, using conventional photolithographic techniques, two rows of offset thin film resistors (501).

Electrodes (503) may also be formed on the semiconductor die (401) for connection (shown by dashed lines) to the conductive traces (407) formed on the back of the tape (209, FIG. 2). A demultiplexer (505), shown by a dashed outline in FIG. 5, may also be formed on the semiconductor die (401) for demultiplexing the incoming multiplexed signals applied to the electrodes (503) and distributing the signals to the various thin film resistors (501).

The barrier layer (403), which may be a layer of photoresist or some other polymer, may include vaporization chambers (507) and ink channels (509). A portion (500) of the barrier layer (403) may insulate the conductive traces (407) from the underlying semiconductor die (401.

In order to adhesively affix the top surface of the barrier layer (403) to the back surface of the tape (209, FIG. 2), a thin adhesive layer (511), such as an uncured layer of poly-isoprene photoresist, may be applied to the top surface of the barrier layer (403). A separate adhesive layer may not be necessary if the top of the barrier layer (403) can be otherwise made adhesive. The resulting substrate structure may then be positioned with respect to the back surface of the tape (209, FIG. 2) so as to align the resistors (501) with the orifices formed in the tape (209, FIG. 2). This alignment step may also inherently align the electrodes (503) with the ends of the conductive traces (407). The traces (407) may then be bonded to the electrodes (503). The aligned and bonded substrate/tape structure is then heated while applying pressure to cure the adhesive layer (511) and firmly affix the substrate structure to the back surface of the tape (209, FIG. 2).

Figure 6:
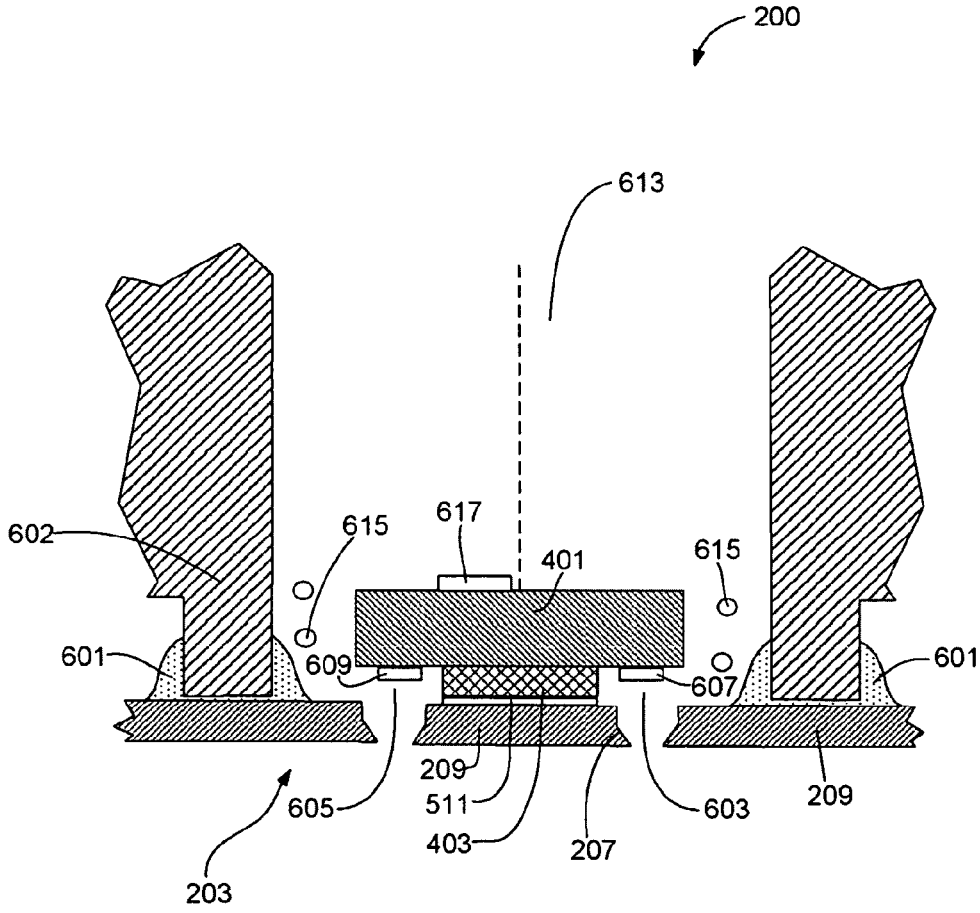
FIG. 6 is a cross-sectional diagram of an embodiment of an illustrative dispensing head having gaseous bubbles disposed within ink channels, according to principles described herein.

Referring now to FIG. 6, a cross-sectional view of a portion of an illustrative fluid-dispensing cartridge (200) and dispensing head (203), as described previously, is shown. In the present example, the cartridge (200) may be an inkjet print cartridge, although the principles described here may be readily applied to other fluid-dispensing systems as noted above.

Adhesive seals (601) may secure at least a portion of the cartridge walls (602) to the tape (209). The barrier layer (403) of the semiconductor die (401) may be secured to the tape (209) using the thin adhesive layer (511). Thin film resistors (607, 609) are shown within the vaporization chambers (603, 605) respectively.

Fluid from a fluid reservoir, for example, an ink reservoir (201, FIG. 2), may flow through a plenum (613) formed in the cartridge (200) and around the edges of the semiconductor die (401) into the vaporization chambers (603, 605) of the dispensing head (203). When the resistors (607, 609) are energized, the fluid within the vaporization chambers (603, 605) may be selectively ejected.

In some embodiments, the fluid reservoir may contain two or more separate fluid sources, for example, each containing a different color of ink. In this alternative embodiment, the plenum (613) in FIG. 6 may be bisected, as shown by the dashed line, so that each side of the plenum (613) may communicate with a separate fluid source. Therefore, the left linear array of vaporization chambers (605) can be made to eject one type of fluid, e.g., color of ink, while the right linear array of vaporization chambers (603) can be made to eject a second type of fluid, e.g., a different color of ink.

This concept can even be used to create a four color dispensing head, where a different ink reservoir feeds ink to ink channels along each of the four sides of the substrate. Thus, instead of the two-edge feed design discussed above, a four-edge design would be used, preferably using a square substrate for symmetry.

As described previously, it may be desirable for many fluid-dispensing systems and cartridges (200) with dispensing heads (203) to be substantially free of gaseous bubbles in fluid channels, such as the plenum (613) and the vaporization chambers (603, 605) for proper operation. However, gaseous bubbles may be introduced into a fluid-dispensing system under a variety of situations, for example, bubbles may occur prior to the commencement of initial fluid-dispensing operations, after long periods of. inactivity, and even during operations. For this reason, many fluid-dispensing systems, such as the cartridge (200) illustrated, rely on priming operations to remove gaseous bubbles (615) from these fluid channels. Priming operations typically force gaseous bubbles (615) out of the dispensing head (203) by pushing fluid through the orifices (207).

Fluid-dispensing systems (e.g., 100, FIG. 1) commonly include fluid pressurization systems configured to provide the dispensing head (203) with fluid from a reservoir, e.g., in the cartridge (200). The fluid may be pressurized such that it may be selectively expelled through the orifices (207) during priming. The pressurization system may include a pump or other method of pressurizing the fluid, according to the needs of particular applications. In some embodiments, gravity may be used to provide dispensing head (203) with the fluid being ejected.

In the present systems and methods, the semiconductor die (401) may be heated such that the gaseous bubbles (615) grow larger during priming and may thus be rendered easier to remove from the dispensing head (203). This heating of the semiconductor die (401) may include passing an electrical current through some or all of the thin film resistors (607, 609) or other dedicated heating elements such that the semiconductor die (401) is warmed by thermal energy dissipated by the energized resistors (607, 609).

During normal fluid-dispensing operations, the thin film resistors (607, 609) may be used to heat surrounding fluid beyond a boiling point of the fluid in the vaporization chambers (603, 605) such that fluid droplets are expelled through the orifices (207) by expanding vapors from the fluid. However, in the present system for priming the dispensing head (203), the thin film resistors (607, 609) may be selectively energized such that the fluid in the general vicinity of the semiconductor die (401) is heated to a temperature such that bubbles (615) expand, but the fluid does not boil. For example, in some embodiments the semiconductor die (401) may be heated to approximately 80 degrees Celsius to facilitate priming the dispensing head (203).

It will be understood that while the present systems incorporate thermal dispensing heads (203) having thin film resistors (607, 609), the principles described herein are not limited to only thermally-actuated fluid-dispensing system. For example, priming systems described herein may be used in conjunction with piezoelectric fluid dispensers, bubble jet fluid dispensers, and other types of fluid dispensers according to specific applications. While some embodiments of fluid-dispensing systems may not require heating element(s) for printing operations, thin film resistors or other heating elements may still be provided disposed within such systems for improved priming operations as described herein.

Control circuitry may selectively activate the thin film resistors (607, 609) as needed to heat the bubbles (615) and surrounding fluid according to priming operations described herein. In some embodiments, this control circuitry may be included in the electronics of a printing system configured to house the inkjet print cartridge (200). Control signals may be received at the semiconductor die (401) in accordance with principles described previously. In other embodiments, the control circuitry may be at least partially housed within the inkjet print cartridge (200), or anywhere else, as may suit a particular application.

In some embodiments, a temperature sensor (617) may be disposed within the dispensing head (203) assembly or elsewhere in the cartridge (200) or dispensing system to measure the temperature of the fluid and/or bubbles (615). The temperature sensor (617) may be in communication with the control circuitry such that the control circuitry may selectively activate/deactivate the thin film resistors (607, 609) to heat the fluid and/or bubbles (615) to a desired temperature.

The volume of a bubble (615) is largely a function of its temperature and the amount of gas contained therein. Therefore, when the fluid in the cartridge (200) or dispensing system is heated by the semiconductor die (401), bubbles (615) within the fluid will also be warmed. This increase in temperature may cause an increase in the volume of the gas in the bubble, as heated gases tend to expand.

According to the ideal gas law, the increase in volume of a heated bubble (615) is directly proportional to the increase in absolute temperature experienced by the bubble (615). For example, according to the ideal gas law, if the absolute temperature of a bubble is increased by 15%, the volume of the bubble (615) will also increase by a corresponding percentage. Furthermore, an increase in fluid temperature also encourages outgassing by moving dissolved gases in the fluid into existing bubbles (615), thus further increasing bubble size and facilitating the removal of gases from the fluid within the cartridge (200) or other fluid-dispensing system while discouraging the formation of subsequent bubbles (615).

As fluid is flushed through the orifices (207) during priming operations, larger bubbles (615) may be easier to move with the flow of the fluid, e.g., requiring less fluid flow pressure to move, than bubbles of the same mass at a lower temperature and smaller size. This may be due, at least partially, to the larger surface area of the enlarged bubbles (615).

Moreover, a bubble (615) that is being primed out of the dispensing head (203) must overcome the pressure and surface tension at the smallest constriction in its path. As bubble pressure is directly proportional to surface tension, and the surface tension of the bubble (615) tends to decrease with increasing temperature, the bubble pressure and surface tension may decrease as the temperature of the bubble (615) increases, even though the bubble is increased in size. Thus, increasing the temperature while priming may also help to reduce the threshold pressure that must be overcome to prime the bubble (615) through the smallest constriction in its path.

In some embodiments, additional thin film resistors or other heating elements may be disposed within the print cartridge (200) or other fluid-dispensing system and the dispensing head (203) assemblies. Additional heating elements may facilitate more uniform and/or effective heating of fluid within a desired priming region.

Figure 7:
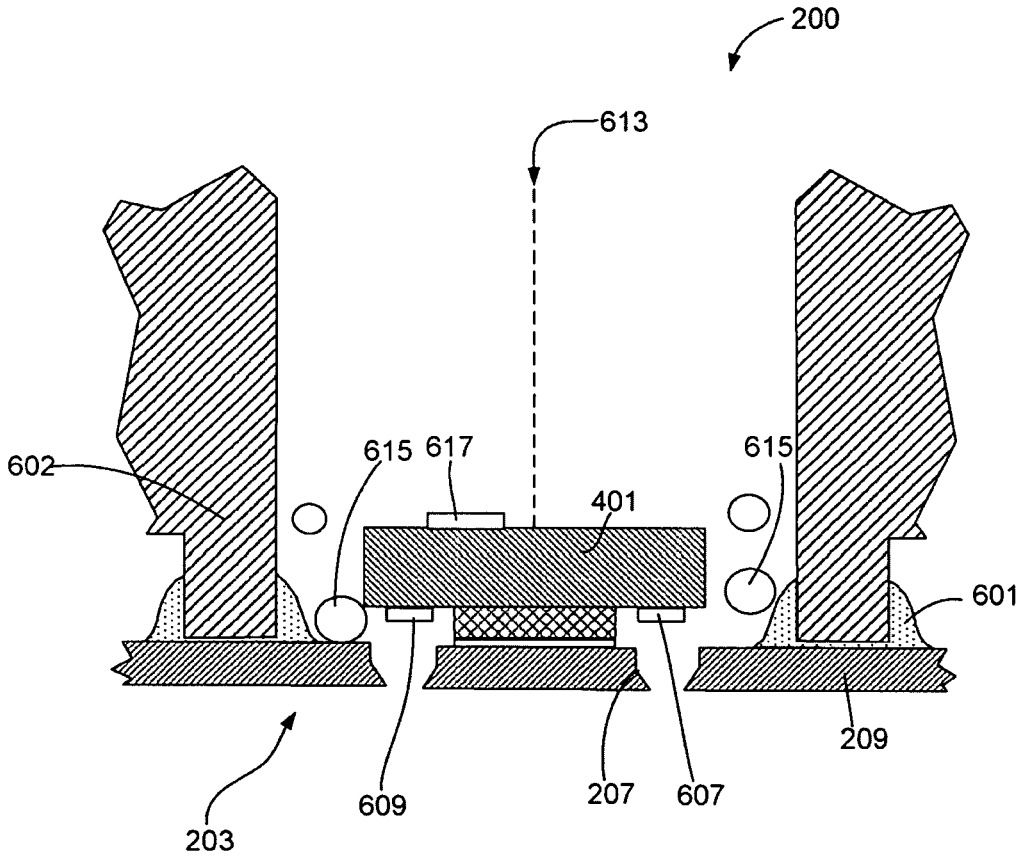
FIG. 7 is a cross-sectional diagram of an embodiment of an illustrative dispensing head having gaseous bubbles disposed within ink channels after a heating step, according to principles described herein.

Referring now to FIG. 7, a cross-sectional view of the illustrative fluid-dispensing system, e.g., an inkjet print cartridge (200), is shown after heating the semiconductor die (401) with the thin film resistors (607, 609) during a priming operation. The bubbles (615) are shown to have grown in size in comparison with their appearance in FIG. 6. The increased surface area and reduced pressure of the bubbles (615) may allow for easier removal of the bubbles (615) through the orifices (207) of the dispensing head (203) as explained above.

Figure 8:
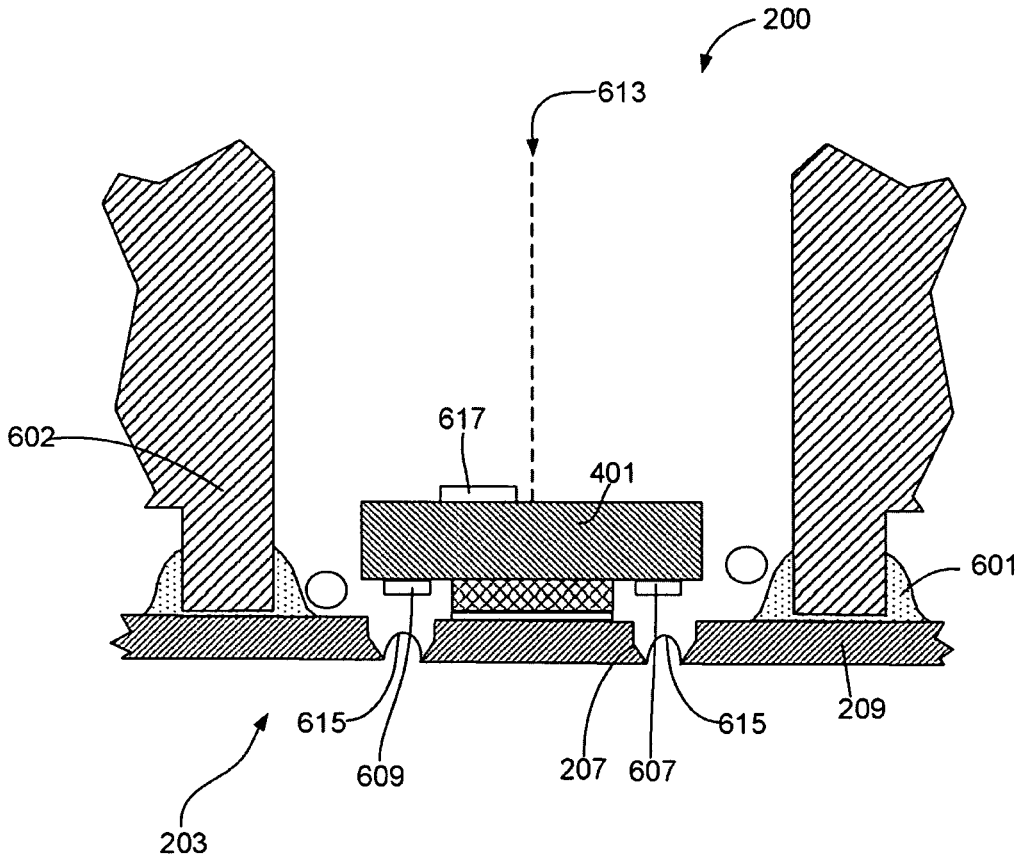
FIG. 8 is a cross-sectional diagram of an embodiment of an illustrative dispensing head during a priming process, according to principles described herein.

Referring now to FIG. 8, a cross-sectional view of the illustrative fluid-dispensing system, e.g., an inkjet print cartridge (200), is shown during another step of the priming operation. In this particular step, heated and enlarged bubbles (615) are shown being expelled through the orifices (207).

In summary, the present systems and methods utilizing die heating for priming operations may provide numerous advantages over previous priming systems. For example, the present systems and methods may enable more effective removal of gaseous bubbles (615) from inkjet print cartridges (200) and other fluid-dispensing systems that include dispensing heads (203) by enlarging the gaseous bubbles (615). The present systems and methods may also enable removal of portion of dissolved gasses thereby reducing the likelihood of subsequent bubble formation. Additionally, warming the fluid and gaseous bubbles (615) during priming may help reduce surface tension that needs to be overcome when passing the gaseous bubbles (615) through constrictions in the dispensing heads (203).

Because of the more efficient removal of the gaseous bubbles (615), less fluid may be used during priming operations, thus conserving more fluid for actual dispensing operations. This may also decrease damage to the environment and increase customer value.

Illustrative Method

Figure 9:
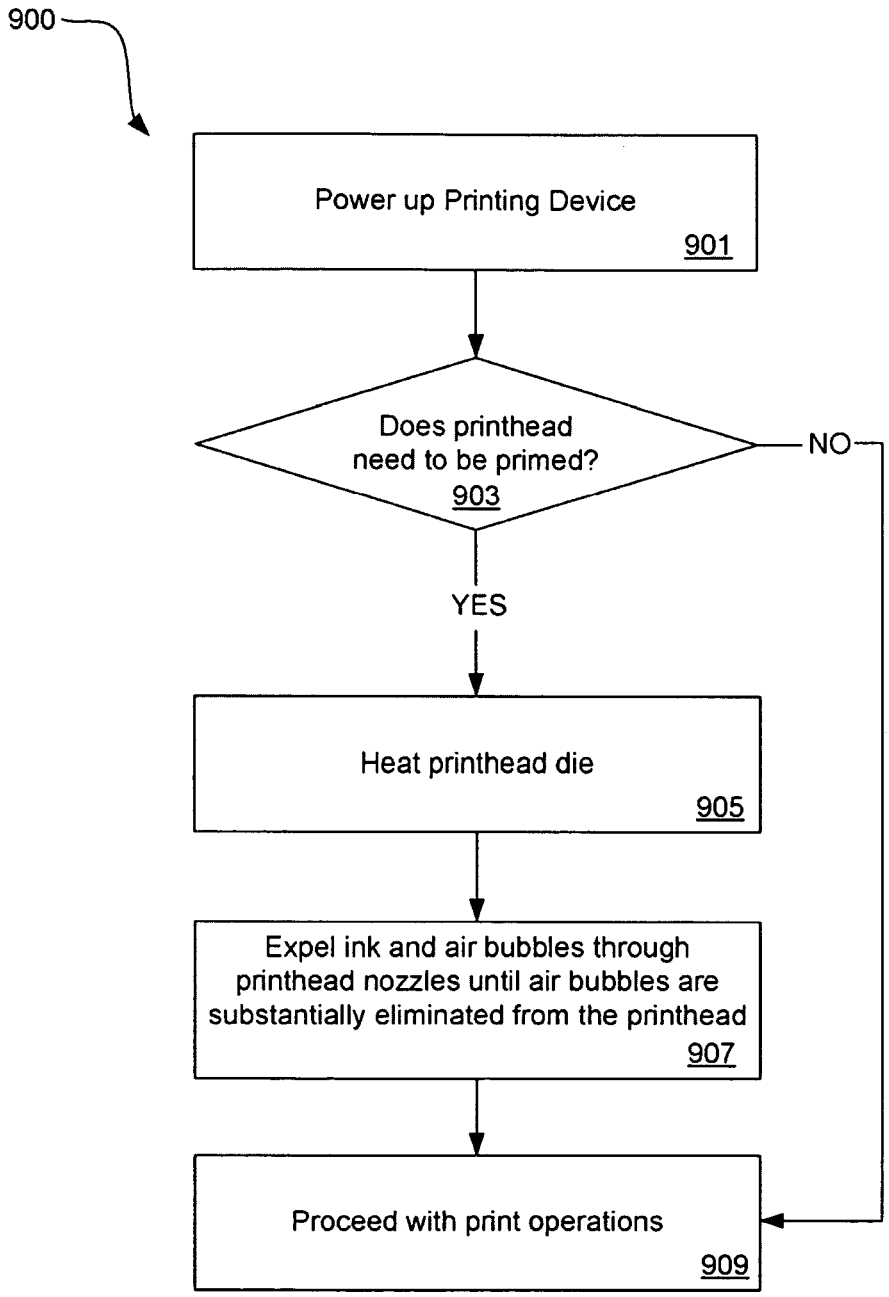
FIG. 9 is a block diagram of an embodiment of an illustrative method of priming a dispensing head, according to principles described herein.

Referring now to FIG. 9, a block diagram of an illustrative method (900) of priming a fluid-dispensing head is shown. The illustrative method (900) may be performed by a printing device such as an inkjet printer or by any of a variety of other fluid-dispensing systems. The method (900) includes powering (step 901) up a fluid-dispensing device and evaluating (decision 903) if a dispensing head in the device needs to be primed.

In the event that it is determined (decision 903) that the dispensing head does not need to be primed, the fluid-dispensing device may then proceed (step 909) with operations.

However, if it is determined (decision 903) that the dispensing head does need to be primed, the dispensing head die is heated (step 905). This heating may cause gaseous bubbles disposed within the dispensing head and elsewhere in the fluid-dispensing system to increase in surface area, thus facilitating the removal of the gaseous bubbles from the dispensing head through orifices in the dispensing head.

The dispensing head die may be heated (step 905) using thin film resistors or other heating elements disposed within the fluid-dispensing device. Furthermore, temperature input from a temperature sensor may be used to control the heating of the dispensing head die such that fluid and gaseous bubbles in the general vicinity of the die are heated to a desired temperature or range of temperatures. For example, the fluid and gaseous bubbles may be heated to a temperature that is greater than the ambient temperature of the device, but less than the boiling point of the fluid.

The fluid and gaseous bubbles are then expelled (step 907) through the dispensing head orifices until the gaseous bubbles are substantially eliminated from the dispensing head. This may be done using a fluid pressurization system, a pump, and/or gravity. The fluid-dispensing device may then proceed (step 909) with operations.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A fluid-dispensing head comprising:

at least one body supporting at least one heating element wherein said at least one heating element heats said body such that fluid around said body is heated and gas bubbles within said fluid increase in surface area; and at least one dispensing head orifice, wherein said body heats said fluid to a temperature greater than an ambient temperature but lower than a boiling point of said fluid prior to said bubbles with increased surface area being expelled from said fluid dispensing head through said at least one orifice in a priming operation.

2. The fluid dispensing head of claim 1, wherein said at least one heating element comprises a thin film resistor.

3. The fluid dispensing head of claim 1, wherein said at least one heating element is selectively activated by control circuitry during said priming operation.

4. The fluid dispensing head of claim 3, wherein said control circuitry is in communication with a temperature sensor and said control circuitry is configured to heat said body with said at least one heating element based on output from said temperature sensor.

5. The fluid dispensing head of claim 1, wherein said fluid dispensing head is incorporated into a print cartridge, wherein said print cartridge comprises a plenum, and wherein said plenum is in fluid communication with a reservoir of ink.

6. The fluid dispensing head of claim 5, wherein said at least one heating element is selectively activated by control circuitry during a priming operation.

7. The fluid dispensing head of claim 6, wherein said control circuitry is in communication with a temperature sensor and is configured to heat said body with said at least one heating element based on output from said temperature sensor.

8. The fluid dispensing head of claim 6, wherein said control circuitry is configured to interface with an external computing device.

9. The fluid dispensing head of claim 1, wherein a fluid pressurization system is configured to apply pressure on said fluid.

* * * * *